United States Patent [19]

Hinkamp

[11] 4,336,033

[45] Jun. 22, 1982

[54] FUEL COMPOSITIONS CONTAINING IRON PENTACARBONYL

[75] Inventor: James B. Hinkamp, Birmingham, Mich.

[73] Assignee: Ethyl Corporation, Richmond, Va.

[21] Appl. No.: 272,500

[22] Filed: Jun. 11, 1981

Related U.S. Application Data

[63] Continuation-in-part of Ser. No. 128,406, Mar. 10, 1980, abandoned.

[51] Int. Cl.[3] ..... C10L 1/18; C10L 1/30

[52] U.S. Cl. ..... 44/68; 252/386

[58] Field of Search ..... 44/67, 68; 252/386

[56] References Cited

U.S. PATENT DOCUMENTS

| | | | |
|---|---|---|---|
| 2,546,421 | 3/1951 | Bartholomew | 252/386 |
| 2,546,422 | 3/1951 | Cross | 252/386 |
| 3,880,612 | 4/1975 | Östergren et al. | 44/68 |

*Primary Examiner*—Winston A. Douglas
*Assistant Examiner*—J. V. Howard
*Attorney, Agent, or Firm*—Donald L. Johnson; Joseph D. Odenweller; Teresa M. Stanek

[57] ABSTRACT

An improved fuel composition comprising a major amount of hydrocarbons boiling in the gasoline boiling range, and a minor amount of iron pentacarbonyl capable of improving the octane number rating of the composition but insufficient to cause excessive wear in engine parts when the fuel composition is burned in an internal combustion engine.

1 Claim, No Drawings

FUEL COMPOSITIONS CONTAINING IRON PENTACARBONYL

CROSS-REFERENCE TO RELATED APPLICATION

This application is a Continuation-In-Part of pending application Ser. No. 128,406, filed Mar. 10, 1980, now abandoned.

BACKGROUND OF THE INVENTION

This invention concerns a lead-free or substantially lead-free hydrocarbon fuel composition for spark-ignition internal combustion engines comprising a major amount of hydrocarbons boiling in the gasoline boiling range and a minor amount of iron pentacarbonyl sufficient to confer valuable antiknock properties to the fuel composition but insufficient to cause excessive wear in engine parts when the fuel composition is burned in a spark-ignited internal combustion engine.

Fuel compositions often include at least one additive to improve the antiknock properties of the composition. The antiknock properties of a fuel composition are directly related to and often measured by, the octane number rating of the composition. Thus, if the octane number rating of a fuel composition increases, the antiknock properties of that composition improve. Because of the capital investment required to improve the inherent antiknock properties of hydrocarbon based fuel compositions by means of refinery processing techniques, workers in this area have sought over the years to improve the octane number rating of fuel compositions by developing fuel additives which improve fuel antiknock properties. Fuel additives which improve fuel antiknock properties by even a fraction of a single octane number represent a significant development.

In the past, it has been demonstrated that iron pentacarbonyl is a good antiknock agent and as such compares favorably with tetraethyl lead. This compound which is easily and inexpensively made from readily available iron and carbon monoxide has the economic advantage of being inexpensive to produce. However, when a fuel containing it is burned in an internal combustion engine, it has heretofore had the disadvantage of causing unacceptable wear in the engine parts, particularly wear of the piston rings. The abrasive properties of iron pentacarbonyl have thus far effectively prevented its use commercially in motor vehicles. Attempts have been made to solve the wear problem inherent in the use of iron pentacarbonyl as an antiknock agent in hydrocarbon fuels by the use of wear inhibitors. Examples of wear inhibitors which have been tried are described in U.S. Pat. Nos. 2,546,421 and 2,546,422. U.S. Pat. No. 2,542,421 discloses, as preferred inhibitors, the metal enolates including acylacetonates, such as acetylacetonate and propionylacetonates, alkylaminomethylene acetonates, such as methylaminomethylene acetonates and ethylaminomethylene acetonates; the metal salts of carboxylic acids including naphthenates, alkylphthalates, such as butyl phthalate and 2-ethylhexyl phthalate, and alkenyl succinimates; and metal salts of alkylcarbamic acids and their sulfur analogs, such as dibutylcarbamate, dibutyldithiocarbamate, diamyldithiocarbamate and di-(2-ethylhexyl)-dithiocarbamate. Also, organic derivatives of certain of the metalloids, such as triphenyl arsine and triphenyl antimony also reportedly substantially reduce wear. U.S. Pat. No. 2,546,422 discloses organic phosphates as wear inhibitors for iron carbonyl. Still, this material has never found wide-spread commercial use despite the virtues and advantages with which it has seemed to be endowed.

SUMMARY OF THE INVENTION

Briefly, it is the concept of the present invention to provide, as an improved fuel for use in a spark ignition internal combustion engine, a lead-free fuel composition which comprises a major amount of hydrocarbons boiling in the gasoline boiling range and a minor amount of iron pentacarbonyl sufficient to provide the fuel composition with improved antiknock properties, as measured by improved octane number rating, yet insufficient to produce unacceptable engine wear in an internal combustion engine which is operated on the fuel composition. This is accomplished by incorporating in a normally liquid hydrocarbon fuel of the gasoline boiling range iron pentacarbonyl in an amount sufficient to provide from about 0.01 to about 0.22 grams of iron for each gallon of gasoline.

DESCRIPTION OF THE PREFERRED EMBODIMENT

Thus, an embodiment of the present invention is a lead-free or substantially lead-free hydrocarbon fuel composition for spark-ignition internal combustion engines comprising a major amount of hydrocarbons boiling in the gasoline boiling range and a minor amount of iron pentacarbonyl sufficient to confer antiknock properties to the fuel composition but insufficient to cause excessive wear in engine parts in an internal combustion engine which is operated on said fuel composition.

The fuels to which the iron pentacarbonyl additive compound of this invention may be added to improve their antiknock properties include all of the volatile liquid fuels known to be suitable for spark ignition internal combustion engines. Typically, the base fuel comprises hydrocarbons which boil primarily in the gasoline boiling range, i.e. from about 50° F. to about 500° F. This base fuel may consist of straight chain or branched chain paraffins, cycloparaffins, olefins and aromatic hydrocarbons or any mixture of these. This fuel can be derived from straight run naphtha, alkylate gasoline, polymer gasoline, natural gasoline or from catalytically cracked or thermally cracked hydrocarbons and catalytically reformed stocks. In general, any conventional substantially hydrocarbon motor fuel base may be employed in the practice of this invention.

The base fuel may contain any of the additives normally employed in a motor fuel. For example, the base fuel may contain anti-icing agents, detergents, demulsifiers, corrosion inhibitors, dyes, deposit modifiers, multi-purpose additives and the like. However, preferably, the present fuel compositions are lead-free or substantially lead-free.

The iron carbonyl compound of this invention may also be used as an antiknock additive in an antiknock fluid. An antiknock fluid is a concentrate containing antiknock additives, and optionally, scavengers, dyes, stabilizers, and other additives. This concentrate may be conveniently blended with the fuel thus facilitating the addition of a number of additives to the fuel in only one step.

The amount of iron pentacarbonyl employed in the present invention is a minor amount sufficient to increase the antiknock result of the fuel, yet insufficient to cause unacceptable engine wear when the fuel is burned in a spark-ignited internal combustion engine. In general, the concentration of the iron component in the fuel should be enough to provide from at least 0.01 to no greater than 0.22 gram of iron for each gallon of fuel. A preferred amount is from about 0.12 to about 0.17 grams of iron per gallon of fuel.

Methods of preparing iron pentacarbonyl are well known to those skilled in the art. As aforementioned, iron pentacarbonyl can be made simply by the reaction, at elevated temperature and pressure, of metallic iron and carbon monoxide.

The following examples illustrate the invention.

EXAMPLE 1

The following tests were conducted to determine the concentration of iron, as iron pentacarbonyl, required to provide one road octane increase in several unleaded gasolines.

Road octane numbers were determined on three base fuels at 0.0, 0.1, 0.2 and 0.3 grams of iron per gallon of gasoline as iron pentacarbonyl in three different makes of cars using the Modified Uniontown Technique (CRC Designation F-28-965). Two of the base fuels were unleaded regular gasolines (designated Fuel No. 1 and Fuel No. 2, respectively) and one was an unleaded premium grade gasoline (designated Fuel No. 3). In each of the fuel compositions containing iron pentacarbonyl, an amount of iron pentacarbonyl (obtained commercially from the Ventron Corporation, Alfa Products, P.O. Box 299, 152 Andover St., Danvers, Mass. was added to the fuels with sufficient blending to insure a uniform composition having the aforespecified concentrations of iron per gallon of fuel. The three cars were a 4-cylinder 1976 Chevrolet Chevette, a 6-cylinder 1978 Ford Fairmont, and a 6-cylinder 1975 Plymouth Fury. Fuel and vehicle specifications are shown in Table 1 below. Each set of fuels was tested three separate times in each car and an average road octane number was obtained. The cars were operated in the highest gear at maximum throttle opening for the Uniontown accelerations. The Chevette was tested at 8 inches Hg manifold vacuum which was the maximum knock part-throttle vacumm.

TABLE 1

VEHICLE AND FUEL SPECIFICATIONS

| | VEHICLES | | |
|---|---|---|---|
| Make/Model | Chevette | Fairmont | Plymouth |
| Year | 1976 | 1978 | 1975 |
| Engine | L-4 | L-6 | L-6 |
| Displacement | 1.6 liter | 200 cu. in. | 225 cu. in. |
| Carb. bbl | 1 | 1 | 1 |
| Comp. ratio | 8.6 | 8.5 | 8.4 |
| Transmission | Manual | Automatic | Automatic |
| Size | Subcompact | Compact | Full Size |
| | FUELS | | |
| Designation | Fuel No. 1 | Fuel No. 2 | Fuel No. 3 |
| RON (ASTM D-2699) | 93.2 | 91.1 | 96.0 |
| MON (ASTM D-2700) | 83.1 | 83.0 | 86.2 |
| Aromatics, Vol. % | 24.0 | 29.0 | 27.7 |
| Olefins, Vol. % | 9.5 | 4.0 | 12.3 |
| Saturates, Vol. % | 66.5 | 67.0 | 60.0 |
| Sulfur Content (wt. %) | 0.043 | 0.03 | unknown |

Road octane numbers and average road octane increases for the three iron pentacarbonyl concentrations tested are shown in Table 2 below.

TABLE 2

| | ROAD OCTANE NUMBERS | | | | | | | |
|---|---|---|---|---|---|---|---|---|
| Fe, G/gal | 0.0 | | 0.1 | | 0.2 | | 0.3 | |
| | Fuel No. 1 (Unleaded Regular) | | | | | | | |
| Chevette | *91.2 | (.76) | *92.8 | (.52) | *93.6 | (.78) | *94.2 | (.61) |
| Fairmont | *88.9 | (.26) | *89.5 | (.44) | *90.0 | (.60) | ( ) (.52) | |
| Plymouth | *82.9 | (1.08) | *83.4 | (.97) | *83.6 | (1.36) | separate (1.17) | |
| Avg | 87.7 | | 88.6 | separate 89.1 | | 89.6 | | |
| Avg. Road Octane Increase | — | | 0.9 | | 1.4 | | 1.9 | |
| Chevette Part Throttle | **88.1 | (.56) | **88.7 | (.64) | **88.8 | (.85) | **89.2 | (.71) |
| | Fuel No. 2 (Unleaded Regular) | | | | | | | |
| Chevette | *90.2 | (1.08) | *91.3 | (.91) | *92.4 | (.38) | *93.5 | (.25) |
| Fairmont | *88.7 | (.25) | *88.9 | (.92) | *89.6 | (.58) | *89.8 | (.51) |
| Plymouth | *81.6 | (.15) | *81.8 | (.15) | *82.3 | (.15) | *83.4 | (.46) |
| Avg. | 86.8 | | 87.3 | | 88.1 | | 88:9 | |
| Avg. Road Octane Increase | — | | 0.5 | | 1.3 | | 2.1 | |
| Chevette Part Throttle | **87.6 | (.70) | **88.1 | (.56) | **88.5 | (.49) | **88.8 | (.42) |
| | Fuel No. 3 (Unleaded Premium) | | | | | | | |
| Chevette | *95.1 | (.30) | *95.5 | (.12) | *96.4 | (.36) | *96.7 | (.25) |
| Fairmont | *91.2 | (.47) | *91.6 | (.45) | *91.9 | (.32) | *91.7 | (.24) |
| Plymouth | *84.0 | (.95) | *84.4 | (.91) | *84.9 | (.93) | *85.8 | (1.29) |
| Avg. | 90.1 | | 90.5 | | 91.1 | | 91.4 | |
| Avg. Road Octane Increase | — | | 0.4 | | 1.0 | | 1.4 | |
| Chevette Part Throttle | **89.6 | (.28) | **89.8 | (.07) | **90.0 | (.00) | **90.2 | (.28) |

Numbers in () are the standard deviations
*average from 3 seperate tests
**average from 2 seperate tests By graphically comparing the average road octane increase produced by the three concentrations of iron present as iron pentacarbonyl in the fuel compositions, the concentration or iron, as iron pentacarbonyl, required to give a 1.0 road octane increase could be determined. It was found to be approximately 0.12 grams of iron per gallon in Fuel No. 1, 0.17 grams of iron per gallon in Fuel No. 2 and 0.22 grams of iron per gallon in Fuel No. 3 for an average of 0.17 grams of iron per gallon. Individual car data are shown in Table 3 below.

TABLE 3

| | Grams/Gallon Fe Required to Provide One Road Octane Increase | | | |
|---|---|---|---|---|
| | Fuel No. 1 | Fuel No. 2 | Fuel No. 3 | |
| Fairmont | 0.180 | 0.260 | 1.13 | Extrapolated |
| Plymouth | 0.260 | 0.230 | 0.210 | |
| Chevette | 0.055 | 0.090 | 0.160 | |
| 3 Car Avg. | 0.12 | 0.17 | 0.22 | |

The effectiveness of iron pentacarbonyl at part throttle was found to be only about 40% of that at maximum throttle in the Chevette. Average road octane increase for maximum throttle and part-throttle for the Chevette are shown in Table 4 below.

TABLE 4

| | Chevette Road Octane Increase | | |
|---|---|---|---|
| | 0.1 Fe g/gal | 0.2 Fe g/gal | 0.3 Fe g/gal |
| Max Throttle | 1.03 | 1.97 | 2.63 |
| Part Throttle | 0.43 | 0.67 | 0.97 |
| Difference | 0.60 | 1.30 | 1.66 |

Referring to Table 4, it was found that road octane numbers were reduced approximately 0.6 to 1.6, depending on the iron concentration when the fuels were tested at part throttle. CRC octane requirement surveys have reported at the 90% satisfaction level that part throttle requirements were 2.1, 3.0 and 1.8 numbers lower than maximum throttle requirements for the model years 1976, 1977, and 1978 respectively. Therefore, the loss of iron effectiveness at part throttle is compensated for by the reduction of octane requirement. Air fuel ratios measured at the testing conditions at maximum and part-throttle in the Chevette indicated that reduction in iron effectiveness during operation at part-throttle was probably due primarily to leaning of the air fuel mixture, i.e. as the air fuel mixture became leaner, the iron effectiveness was reduced.

EXAMPLE 2

A dynamometer test was conducted to determine if engine durability and performance were affected by the presence of a low concentration of iron pentacarbonyl in a fuel burned in the engine. The durability aspects were quantified by making engine wear measurements before and after the test. A 4.2 liter, 6-cylinder internal combustion engine was equipped with two separate carburetors and a divided intake manifold which permitted running the engine on two different fuels simultaneously. Three cylinders were supplied with a regular lead-free gasoline having the following composition:

| | |
|---|---|
| RON (ASTM D-2699) | 93.08 |
| MON (ASTM D-2700) | 84.47 |
| Aromatics, Vol. % | 23.5 |
| Olefins, Vol. % | 10.0 |
| Saturates, Vol. % | 66.5 |
| Sulfur Content (wt. %) | 0.045 |

The other three cylinders were supplied with the identical fuel composition except that it contained 0.15 grams of iron per gallon of fuel as iron pentacarbonyl (268.2 grams of iron pentacarbonyl dissolved in 500 gallons of base fuel). With this arrangement, half of the cylinders were exposed only to oil circulating debris from the combustion of iron pentacarbonyl burned in the first three cylinders. Separate wear measurements of each set of three cylinders were made at the start and end of test to obtain quantitative measurements of wear with and without the additive. Indicators of engine durability which could be measured without engine disassembly were monitored continuously throughout the test. These included oil consumption, the volume of engine blowby gases past the rings, cylinder compression pressures and exhaust emissions. The performance of the engine was monitored by periodically measuring intake manifold vacuum and fuel consumption while maintaining the prescribed cruise brake horsepower and engine speed. The engine was operated on a cycle consisting of freeway speed and load of 2,200 rpm and 33 BHP (cruise condition) for 4.5 minutes and idle at 650 rpm for 30 seconds for a total of 500 hours. This is equivalent to about 25,000 miles of normal highway driving. The outward indicators of engine durability and performance at the start of test and after 500 hours are shown in Table 5 below.

TABLE 5

| Durability and Performance Dual Fuel 250 CID Engine Dynamometer Test of Fe $(CO)_5$ and Unleaded Regular Gasoline | Start of Test | End of 500 hr. |
|---|---|---|
| Durability Factors | | |
| Oil Consumption Rate, lb/hr | 0.08[a] | 0.04 |
| Blowby, cfm at 2200 rpm | 1.07[b] | 0.89 |
| Compression Pres., psig | | |
| Avg. of Cyls. with Fe | 175 | 176 |
| Avg. of Cyls. without Fe | 175 | 185 |
| HC Emissions, ppm at 2200 rpm (cruise) | 363 | 357 |
| Performance Factors at 2200 rpm Cruise | | |
| Fuel Consumption, lb/hr | | |
| Carb. 1 with Fe | 9.8 | 9.8 |
| Carb. 2 without Fe | 10.0 | 10.1 |
| Brake Specific Fuel Consumption lbs. of fuel per BHP-hr. | 0.62 | 0.60 |
| Intake Manifold Vacuum, in. Hg. | | |
| Intake Manifold with Fe | 13.0 | 12.6 |
| Intake Manifold without Fe | 12.8 | 12.2 |
| Observed Brake Horsepower | 31.9 | 33.0 |

[a]After 100 hours
[b]At 3.5 test hours

These data show that at the end of 500 hours there was no outward indication of engine deterioration. That is, oil consumption, engine blowby gases and hydrocarbon exhaust emissions had not increased from the start of test. Also, cylinder compression pressures were all high. Furthermore, engine performance factors showed no signs of deterioration at the end of 500 hours. That is, fuel consumption per se and specific fuel consumption (lbs. of fuel per BHP-hr.) did not change. In addition, intake manifold vacuum required to run the engine at 2,200 rpm and 33 BHP did not change significantly during the course of the test. Two spark plugs in the iron pentacarbonyl cylinders failed due to gap bridging; one at 257 hours (12,800 miles) and the other at 397 hours (19,850 miles) of operation. Failures were the result of misfire at idle, not at cruise conditions.

Dimensional and weight changes of critical engine components after 500 hours of operation are set forth in Table 6 below.

TABLE 6

WEAR MEASUREMENT RESULTS
Dual-Fuel 250 CID Engine Dynamometer Test
of Iron Pentacarbonyl and Unleaded Regular Gasoline
500 Hours (or 25,000 Miles)

| Item | Avg. 3 Cyls. Clear Fuel | Avg. 3 Cyls. $Fe(CO)_5$ |
|---|---|---|
| Cylinder Bore: | | |
| Dia. increase, in. | 0.0009 | 0.0009 |
| Ridge height, in. | 0.0006 | 0.0010 |
| Piston Ring Weight Loss: | | |
| Top compression, g. | 0.0356 | 0.1991 |
| Second compression, g. | 0.0324 | 0.1224 |
| Pr. oil rings, g. | 0.0367 | 0.0507 |
| Piston Ring Gap Increase: | | |
| Top compression, in. | 0.0003 | 0.0047 |
| Second compression, in. | 0.0027 | 0.0067 |
| Connecting Rod Bearing: | | |
| Wt. Loss, top, g. | 0.0363 | 0.0350 |
| Wt. loss, bottom, g. | 0.0080 | 0.0076 |
| Intake Valves: | | |
| Face runout increase, in. | 0.0009 | 0.0022 |
| Seat runout increase, in. | 0.0008 | 0.0009 |
| Tip height increase, in. | 0.0030 | 0.0013 |
| Guide wear | 0.0013 | 0.0015 |
| Exhaust Valves: | | |
| Face runout increase, in. | 0.0012 | 0.0005 |
| Seat runout increase, in. | 0.0004 | 0.0012 |
| Tip height increase, in. | 0.0013 | 0.0030 |
| Guide wear | 0.0003 | 0.0012 |
| Valve Lifter Wear, in. | 0.0003 | 0.0004 |
| Deposit Weights: | | |
| Combustion chamber, g. | 2.1727 | 1.9068 |
| Piston tops, g. | 1.9271 | 1.2219 |
| Visual Cleanliness Ratings: | | |

TABLE 6-continued

WEAR MEASUREMENT RESULTS
Dual-Fuel 250 CID Engine Dynamometer Test
of Iron Pentacarbonyl and Unleaded Regular Gasoline
500 Hours (or 25,000 Miles)

| Item | Avg. 3 Cyls. Clear Fuel | Avg. 3 Cyls. $Fe(CO)_5$ |
|---|---|---|
| (10 = clean) | | |
| Piston ring lands and grooves | 7.4 | 6.1 |
| Carburetor | 7.8 | 6.9 |
| Timing Chain Deflection: | | |
| New 0.109 in. | | |
| 500 Hours 0.136 in. | | |
| Increase 0.027 in. | | |
| Engine service limit = .500 in. | | |

Referring to the data set forth in Table 6, none of the wear values were considered excessive since the engine showed no outward signs of deterioration of distress during the test or at the end of the test. However, comparisons between each group of cylinders show somewhat greater wear with iron pentacarbonyl in the regions of the engine that are directly exposed to fresh iron pentacarbonyl combustion products (such as in the area of the piston rings and intake and exhaust valves). However, the amount of wear would appear to be acceptable since it did not adversely influence the performance and durability factors described previously.

I claim:

1. A lead-free or substantially lead-free hydrocarbon fuel composition comprising a major amount of hydrocarbons boiling in the gasoline boiling range and an amount of iron pentacarbonyl sufficient to provide from at least 0.01 to no greater than 0.22 gram of iron for each gallon of fuel, designed to confer antiknock properties to the fuel composition, but not confer excessive wear in engine parts in an internal combustion engine being operated on said fuel composition.

* * * * *